United States Patent [19]

Ng

[11] Patent Number: 4,608,962

[45] Date of Patent: Sep. 2, 1986

[54] GLASS COUNTERTOP RANGE MOUNTING

[75] Inventor: W. S. Dominic Ng, Kitchener, Canada

[73] Assignee: Camco Inc., Mississauga, Canada

[21] Appl. No.: 802,730

[22] Filed: Nov. 29, 1985

[30] Foreign Application Priority Data

Mar. 22, 1985 [CA] Canada ..... 477242

[51] Int. Cl.[4] ..... F24C 15/10

[52] U.S. Cl. ..... 126/211; 219/459; 219/463; 219/467

[58] Field of Search ..... 126/1 R, 39 B, 39 E, 126/39 F, 39 J, 211, 214 A, 214 B, 214 C, 220; 219/443, 445, 458, 459, 463, 464, 467, 520, 536, 542

[56] References Cited

U.S. PATENT DOCUMENTS 3,586,825 6/1971 Hurley ..... 126/39 J X
3,830,216 8/1974 Dodd ..... 126/39 J
3,838,505 10/1974 Donor ..... 219/459 X
3,866,018 2/1975 Hurko ..... 219/459 X
4,363,956 12/1982 Scheidler et al. ..... 219/464

FOREIGN PATENT DOCUMENTS 76480 5/1918 Fed. Rep. of Germany ..... 219/459

*Primary Examiner*—Margaret A. Focarino
*Attorney, Agent, or Firm*—Raymond A. Eckersley

[57] ABSTRACT

A glass top countertop range is mounted on a structure formed by a first box structure that fits through a hole in the countertop and is supported by a peripheral flange and a second, but inverted, box structure significantly smaller than the first box structure and telescopingly received in the first box structure to provide an air space between the two box structures. The top of the second box structure lies in face to face relationship with a glass top of the range and the glass top is secured to the and supported by the second box structure which in turn is supported in the first box structure.

4 Claims, 3 Drawing Figures

GLASS COUNTERTOP RANGE MOUNTING

FIELD OF THE INVENTION

The present invention relates to a glass topped countertop range. More specifically the present invention relates to a glass topped countertop stove mounting structure incorporating a pair of telescoping box structures.

BACKGROUND OF THE PRESENT INVENTION

Generally a countertop range is supported on a single box structure having both its bottom and top ends closed, and provided with suitable passages through the top to receive the heating elements. Servicing is generally performed by removing the bottom panel which is held to the remainder of the box structure by screws or the like. Such box structures have been used with glass topped countertop ranges and have been provided with suitable vent holes around the periphery of the box in order to maintain the required temperatures when the range is installed and in use. It has been found that in some cases the glass top has cracked or that the ventilation holes are so large that the structure would have difficulty meeting the Canadian Standards Association specification for shielding of the wiring. Also obviously the dropping of the bottom panel to service the unit makes servicing very inconvenient and in some cases very awkward.

BRIEF DESCRIPTION OF THE PRESENT INVENTION

The present invention relates to an improved glass topped countertop range that provides adequate thermal insulation and shielding of the wiring and that may be easily serviced with access from above the countertop and at very limited extra cost.

Broadly the present invention relates to a glass topped countertop range comprising an outer, upwardly opening box structure having a bottom panel and peripheral walls with a peripheral mounting flange means extending substantially parallel to said bottom wall and outward from the box structure adjacent the open end of the box structure, an inner downwardly opening box structure smaller than the outer box structure and having peripheral walls extending from a top panel, said inner box structure being telescoped within said outer box structure with said peripheral walls of said inner box structure, spaced from the peripheral walls of said outer box structure and being supported on said bottom panel, said peripheral wall of said outer box structure and said inner box structure being of a length so that the upper surface of said top panel and of said peripheral flange means are in substantially the same common plane, a glass top overlying said mounting flange means and in face to face relationship with said top panel, cooperating heating element receiving passages through said top panel and said glass panel, a heating element passing through each pair of cooperating heating element receiving passages and mounting means clamping each said heating element, said glass panel and said top panel together.

Preferably the mounting means for each of the elements includes a flange means on the upper portion of the element to press against the glass panel and clamping arm extending beyond the element and engaging the bottom of said top panel to clamp the glass panel and top panel together.

If desired, further partitions may be provided in the inner box to define a control compartment.

BRIEF DESCRIPTION OF THE DRAWINGS

Further features, objects and advantages will be evident from the following detailed description of the preferred embodiments of the present invention taken in conjunction with the accompanying drawings in which.

BRIEF DESCRIPTION OF THE PREFERRED EMBODIMENTS

Figure 1:
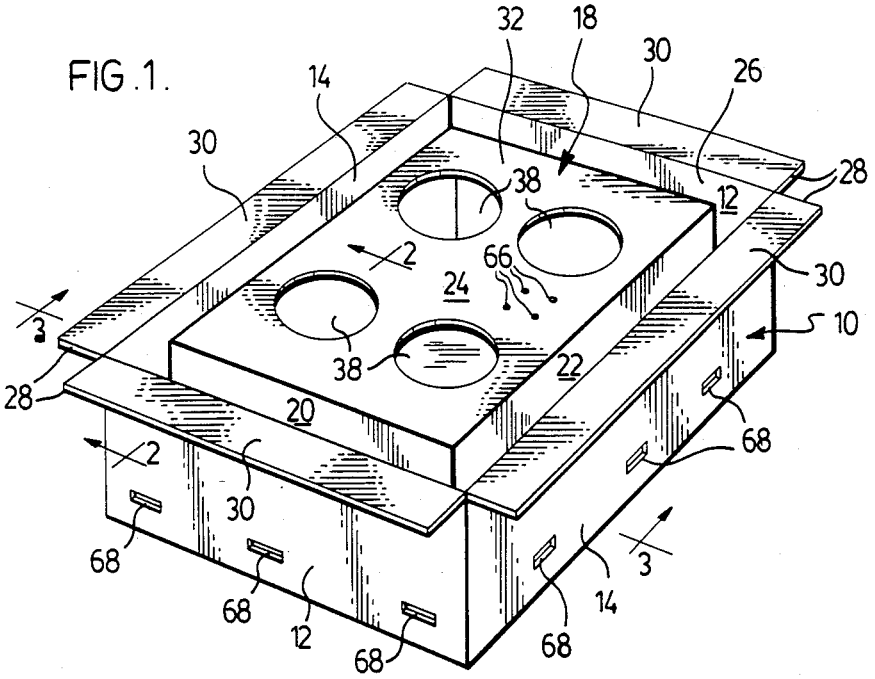
FIG. 1 is an isometric view the box structures of the present invention with the glass top heating elements and controls omitted.

As illustrated in the countertop mounting of the present invention is composed of an outer box 10 having side and end walls 12 and 14 and a bottom wall 16 and an inner box 18 having side and end walls 20 and 22 and a top wall 24. The box structure 10 and 18 normally will be formed from sheet metal to provide the required protection.

The inverted or inner box 18 is significantly smaller than the outer box 10 so that the walls 20 are spaced from the walls 12 and the walls 22 are spaced from the walls 14 to provide a peripheral air space 26 extending around the inner box 18 and between the inner box 18 and outer box 10. This air space 26 provides a heat dissipating insulating chamber obstructing the transfer of heat from the box 18 to the supporting cabinet structure as will be described hereinbelow.

It will be noted that the outer box 10 is formed with peripheral flanges 28 extending outwardly from the open or top end of the box 10 and that these peripheral flanges extend substantially parallel to the bottom wall 16. Furthermore, the top surfaces 30 of the flanges 28 are in substantially the same plane as the top surface 32 of the top member 24 of the inverted or inner box 18 (see FIG. 2) and the height of the peripheral walls of the two boxes are set accordingly.

A glass top 34 formed from a glass panel has its bottom surface 36 in face to face contact with the upper surfaces 30 and 32 and is provided with heating element apertures 36 that are substantially aligned with cooperating similar apertures 38 formed in the top wall 24. Suitable element structures, such as illustrated at 40 in FIG. 2, pass through the cooperating apertures 36 and 38 and are used to clamp the glass plate 34 to the sheet metal supporting structure formed by the inner and outer boxes 10 and 18.

In the illustrated arrangement each heating element 40 has a peripheral flange 42 which overlies a first annular ring 44 having a curved cross section which in turn overlies a supporting ring 46 which has an upwardy extending end portion 48 that is received within the concave portion of the curved ring 44. The ring 46 bears directly against the upper surface 50 of the glass plate 34. A suitable clamp, as schematically illustrated at 52 is secured to the element 40 via a threaded bolt or the like 54 so that tightening of the bolt tightens the clamp 52 against the inner face of the top panel 24 of the inverted box 18 to force the flanges 42 against the annular ring 44 which in turn forces the ring 46 against the upper face 50 while the ends of the clamp 52 bear against the inner face of the top panel 24 thereby to clamp the glass plate 34 to the mounting structure formed by the pair of boxes 10 and 18.

Only a single heating element structure and clamping arrangement has been shown, however it will be apparent that there will one such heating element and clamping arrangement for each pair of cooperating element receiving apertures 36, 38.

Figure 2:
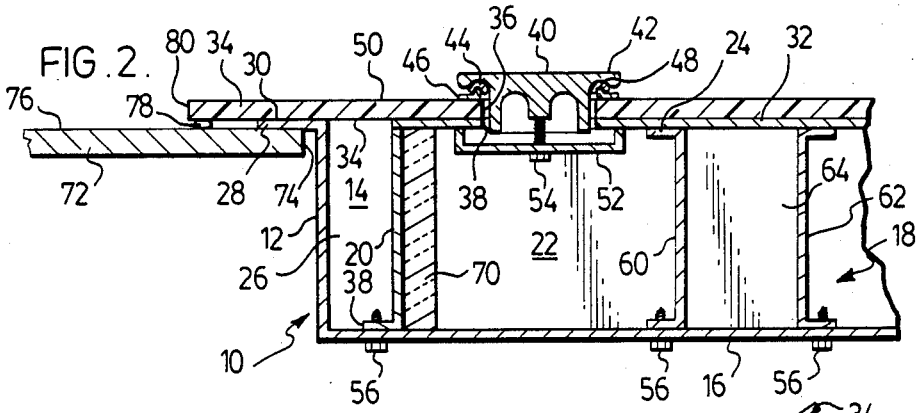
FIG. 2 is a section along the line 2—2 of FIG. 1 illustrating a glass top in position and the unit mounted on a counter.

In the arrangement illustrated the inverted box 18 is secured to the support box 10 via removable fasteners such as those indicated at 56 in FIG. 2, passing up through a peripheral flange 58 extending around the inner box 18 at the ends of the walls 20 and 22 forming the open end of the box 18.

It may be desirable to partition the inner box 18 via a pair of spaced partitions such as those indicated at 60 and 62 to provide an inner compartment generally indicated at 64 in FIG. 2, wherein the controls may be mounted and isolated from the hotter areas which are in direct communication with the heating elements 40. Suitable apertures such as those indicated at 66 will be provided through the top wall 24 to accommodate the stems of the various control knobs for controlling each of the elements. If desired, each of the partition panels 60 and 62 may be provided with outwardly extending flanges through which removable fasteners indicated at 56 may be passed to further secure the inner and outer boxes together. This can also be used as the only means to hold the inner and outer boxes together.

In some cases, depending on the wattage of the elements etc., and the width of air space, it may be desired to provide a suitable ventilation or breathing apertures 68 through the walls 12 and 14 of the outer box 10. Similarly it may be desirable to provide insulation such as that shown at 70 in Figure 2 on the inner faces of at least some of the walls 20 or 22 of the inner box to further limit the transfer of heat from the elements 40 to the supporting structure.

It will be noted that the box 10 is supported on a supporting structure namely a countertop generally indicated at 72 by passing the box 10 through an aperture generally indicated at 74 through the countertop 72 while flanges 28 which project beyond the apertures 74 are supported by the upper surface 76 of the countertop thereby positioning the outer box and inner box within the aperture 74 in the countertop and supporting the range unit via the flanges 28.

A suitable gasket such as that indicated at 78 may be provided around the outer circumference as generally indicated at 80 in FIG. 2 of the glass panel between the glass panel 34 and the countertop 72 to provide a liquid seal between the glass panel and countertop 72.

Figure 3:
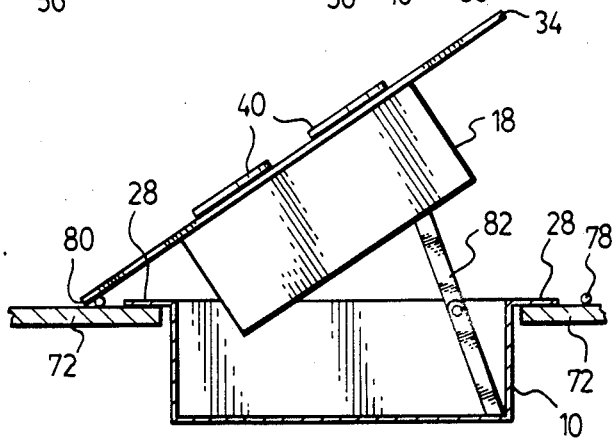
FIG. 3 is a view similar to FIG. 2 but taken along the line 3—3 of FIG. 1 and illustrating the countertop unit in tilted position for servicing.

To service the unit the releasable fasteners 56 must be removed then the inner box 18 with the glass panel 34 secured thereto may be pivotted out of the box 10 into a position similar to that shown in FIG. 3 and supported in this position by a suitable arm means generally indicated at 82, i.e., the heating unit comprising glass panel 34, and box 18 containing heating elements and controls will be pivotted out of the box by pivotting along one peripheral edge 80 of the glass panel 34. This will make the bottom of the elements 40 accessible so that it then becomes an easy matter to release the clamping screw 54 of a given element 40 which will release the clamp 52 and permit the element (when the wire is disconnected) to be lifted from the structure and replaced with a new element. The glass panel 34 will not shift relative to the rest of the box structure 18 unless all of the clamps 52 are released simultaneously which obviously would not, under normal circumstances, or servicing be the case.

It will be apparent that not only are the elements readily exposed for servicing from above the countertop once the operating parts of the unit are moved into the position shown in FIG. 3 but also the controls will be readily available for servicing in the compartment 64.

Having described the invention, modifications will be evident to those skilled in the art without departing from the spirit of the invention as defined in the appended claims.

What I claim as new and desire to secure by Letters Patent of the United States is:

1. A glass top countertop range structure comprising an outer, upwardly opening box structure having a bottom panel and peripheral walls with peripheral mounting flange means extending substantially parallel to the bottom wall outward from said peripheral walls adjacent the upward opening end of said box, an inner downwardly opening box structure having peripheral walls extending from a top panel, said inner box structure being telescoped within said outer box structure to provide a peripheral air space around said outer box structure between said inner and outer box structures, said inner box structure being supported on said bottom wall by said peripheral walls of said inner box structure so that the upper surface of said top panel is in substantially the same plane as the upper surface of said peripheral mounting flange means, a glass top overlying said mounting flange and said top panel and in face to face contact therewith, cooperating heating element receiving passages through said top panel and said glass panel and a heating element mounted in each pair of said cooperating passages by heating element mounting means.

2. A glass topped countertop range structure as defined in claim 1 wherein said element mounting means includes radial flange means extending from said element and adapted to press on said glass panel and a clamp means adapted to engage a bottom surface of said top panel and clamp said glass panel and said top panel together between said radial flange means and said clamping means.

3. A structure as defined in claim 1 further comprising partition means across said inner box structure forming a control space isolated from said elements.

4. A structure as defined in claim 1 further comprising a releasable means to secure ends of said peripheral walls of said inner box structure to said bottom wall for securing said inner box structure to said outer box structure while permitting release of said inner box structure from said outer box structure for servicing.

* * * * *